US006358890B1

(12) United States Patent
Senoo et al.

(10) Patent No.: US 6,358,890 B1
(45) Date of Patent: Mar. 19, 2002

(54) TREATING AGENT FOR PREVENTING GRATING NOISE FROM GENERATING BETWEEN URETHANE FOAM AND METAL SURFACE AND METHOD THEREOF

(75) Inventors: Yasumasa Senoo; Takao Komatsubara; Fumio Goto, all of Kurashiki (JP)

(73) Assignee: Namba Press Works Co., Ltd., Kurashiki (JP)

( * ) Notice: Subject to any disclaimer, the term of this patent is extended or adjusted under 35 U.S.C. 154(b) by 0 days.

(21) Appl. No.: 09/530,070

(22) PCT Filed: May 14, 1999

(86) PCT No.: PCT/JP99/02523

§ 371 Date: Apr. 21, 2000

§ 102(e) Date: Apr. 21, 2000

(87) PCT Pub. No.: WO00/11241

PCT Pub. Date: Mar. 2, 2000

(30) Foreign Application Priority Data

Aug. 24, 1998 (JP) ..... 10-237482

(51) Int. Cl.[7] ..... C25F 1/14; C10M 173/00

(52) U.S. Cl. ..... 508/110; 508/485; 106/1.05; 252/62

(58) Field of Search ..... 508/110, 485; 252/62; 106/1.05

(56) References Cited

U.S. PATENT DOCUMENTS

| | | | | | |
|---|---|---|---|---|---|
| 5,677,027 | A | * | 10/1997 | Masuda et al. | 428/96 |
| 5,720,807 | A | * | 2/1998 | Izumi et al. | 106/696 |
| 5,971,099 | A | * | 10/1999 | Yasuda et al. | 181/286 |
| 6,103,851 | A | * | 8/2000 | Roser et al. | 528/77 |
| 6,153,709 | A | * | 11/2000 | Xiao et al. | 525/528 |

FOREIGN PATENT DOCUMENTS

| | | | |
|---|---|---|---|
| DE | 19546744 | * | 6/1997 |
| EP | 1029742 A | * | 8/2000 |
| JP | 2829344 B2 | * | 11/1998 |

* cited by examiner

*Primary Examiner*—Jacqueline V. Howard
(74) *Attorney, Agent, or Firm*—Renner, Kenner, Greive, Bobak, Taylor & Weber

(57) ABSTRACT

A noise inhibitor for preventing a creaking noise production consisting of: a non-ionic or a carboxylic acid type negative ionic oil-soluble surfactant; and water or a wax emulsion solution, the surfactant being diluted by 2 to 15 times with the water or the wax emulsion solution. The range of HLB of the surfactant is from 8.0 to 10 and the range of pH of the noise inhibitor is from 7.5 to 9.5.

16 Claims, No Drawings

TREATING AGENT FOR PREVENTING GRATING NOISE FROM GENERATING BETWEEN URETHANE FOAM AND METAL SURFACE AND METHOD THEREOF

This application is a 371 of PCT/JP99/02523 May 14, 1999.

TECHNICAL FIELD

The present invention relates to a technique for preventing a creaking noise produced between a foamed urethane and a metallic surface when the foamed urethane touches on the metallic surface. In particular, the present invention relates to a noise inhibitor and a method for preventing a creaking noise produced between a foamed urethane and a metallic surface when an oil component sticks to the metallic surface and the foamed urethane touches on the metallic surface, and the metallic surface is treated using the noise inhibitor, and thereby, such a creaking noise production is inhibited.

BACKGROUND OF THE ART

A foamed urethane material has an excellent property as a cushion material and is thus broadly used for a variety of applications. Such foamed urethane products or parts are used alone or together with metallic frames or plates of, for example, a seat or a bed.

However, as a property of a foamed urethane, the foamed urethane product or part is not smoothly moved on a metallic surface, and thus, a creaking noise is disadvantageously produced when the foamed urethane moves on a metallic surface.

When the foamed urethane is used as a cushion material for a seat of an automobile and the like or a mat of abed, such a creaking noise disturbs its comfortable use. Thus, it is required to prevent or inhibit such a noise production.

In the art, in order to prevent such a noise production, a pad such as a non-woven cloth or a felt cloth is attached on a molded foamed urethane product or part so as not to directly touch the foamed urethane to the metallic surface.

A seat used for an automobile is often manufactured by foaming an urethane material in a mold, and a non-woven cloth is placed in a mold before the molding process so as to attach the non-woven cloth on the molded foamed urethane product or part by foaming and molding the foamable urethane material together with the non-woven cloth, in order to prevent the noise production described above.

The noise production can be prevented if such a non-woven cloth is attached on a foamed urethane. However, the number of the manufacturing process is disadvantageously increased, and the whole manufacturing cost is also increased.

The creaking noise produced between the foamed urethane and the metallic surface depends on the metallic surface condition. For example, the creaking noise is not produced very much if the metallic surface is coated with a coating material consisting of melamine alkyd and the like. However, as a recent tendency of an automobile manufacture, in order to reduce the manufacturing cost, it is abolished to use such a coating material for most of metallic frames excepting a particular metallic frame. Thus, the creaking noise production must be prevented by use of a pad such as a non-woven cloth and a felt cloth, and use of such a pad is disadvantageously very expensive as described above.

Meanwhile, the creaking noise production can be prevented by use of grease or Vaseline instead of use of a non-woven cloth or a felt cloth. Grease or Vaseline is applied to a touching area between the foamed urethane and the metallic surface. It seems that the creaking noise production can be prevented by use of grease because grease does not dry in a short time. However, the foamed urethane and the metallic surface are greasy for a long time, and not only its handling is difficult but also other parts and an installed assembling line are contaminated. Thus, it is substantially difficult to use grease or Vaseline in a manufacturing site.

Recently, "a noise-preventing agent (or a sliding agent)" coated on the foamed urethane is commercially available. However, it is very expensive and a large quantity of the noise-preventing agent must be coated on the foamed urethane in order to achieve a desired effect. In addition to this matter, as well as grease and Vaseline described above, this agent does not dry in a short time, and other parts and an installed assembling line are contaminated. If the agent is completely dried up to avoid this problem, the noise-preventing effect will not be expected. Thus, use of such a noise-preventing agent is limited.

The present invention is made in order to solve those problems, and therefore, an object of the present invention is to provide a noise inhibitor and a method for preventing a creaking noise produced between a foamed urethane and a metallic surface when an oil component sticks to the metallic surface and the foamed urethane touches on the metallic surface.

Another object of the present invention is to provide a noise inhibitor and a method for preventing such a noise without reducing a rust preventing effect even though the oil component of a rust preventing oil sticks to the metallic surface.

Still another object of the present invention is to provide a noise inhibitor and a method capable of preventing such a noise production even though the treated surface is not only in a wet condition but also in a dry condition.

SUMMARY OF THE INVENTION

A noise inhibitor according to the present invention consists of:

- a non-ionic or a carboxylic acid type negative ionic oil-soluble surfactant, or a mixture of this oil-soluble surfactant and a water-soluble surfactant; and
- water, or a water solution of a wax emulsion solution diluted by 1 to 10 times with water, added thereto such that the oil-soluble surfactant is diluted by 2 to 15 times, desirably 5 to 10 times, with the water or the water solution and the range of pH of the noise inhibitor is from 7.5 to 9.5.

If the surfactant is diluted by 2 to 15 times, the resulting solution (i.e. the noise inhibitor) can be easily coated on a metallic surface and at least more than 10% of the surfactant as a solute dissolves in water or the water-solution.

If the range of pH of the noise inhibitor is from 7.5 to 9.5, the resulting noise inhibitor will be excellent in the stability, the coating ability (in particular, by use of spray), the workability and the rust preventing ability. If the range of pH is below 7.5 (i.e. acidity), the anticorrosion will be reduced. Meanwhile, if the range of pH is above 9.5 (i.e. alkalinity), the anticorrosion will be good but the solution stability becomes worse.

Note that the range of HLB (Hydrophile-Lipophile Balance) (the relative simultaneous attraction of an emulsifier for two phases of an emulsion system) of each surfactant is from 8.0 to 10, desirably from 7.5 to 9.5.

If the range of HLB is above 10, the noise inhibitor exhibits a high hydrophilic property so as to "repel" it even though the noise inhibitor diluted with water is coated on a metallic surface, so that the evenly thin coated film layer is not formed over the metallic surface. In addition to this matter, the noise inhibitor coated does not dry in a short time, and this causes that not only the workability becomes worse but also the creaking noise preventing ability is reduced. Meanwhile, if the range of HLB is below 8, the noise inhibitor has a high lipophilic property, so that several properties such as the drying ability, the workability and the creaking noise preventing ability are good and the anticorrosion is improved, but the solution stability becomes worse and the solution is separated.

The noise inhibitor of the present invention can be coated on a metallic surface to which an oil component of a rust preventing oil and the like sticks, by applying a coating technique appropriately selected from means of spraying, brush-painting, role-coat and the like.

After coating, the oil component is emulsified or gelled and the viscosity thereof is almost vanished. Thus, the non-viscous coated film layer is stably and reliably formed over the metallic surface, and this layer is placed between the foamed urethane and the metallic surface, and thereby, the creaking noise production is prevented.

The noise inhibitor of the present invention has no toxicity to a human body and no stimulation to a skin.

BEST MODE FOR CARRYING OUT THE INVENTION

In order to examine a mechanism of a creaking noise produced between a foamed urethane and a metallic surface (steel surface), a variety of tests were carried out. The result is as shown in table 1.

TABLE 1

(Foamed Urethane/Metallic Surface Noise Production Test)

| Test surface | Test oil | Condition | | Noise production |
|---|---|---|---|---|
| Steel Plate SPCC (automobile) | Rust preventing oil *1 | Half Dry (viscous) | XX | (Large Noise) |
| | Operating oil Lubricating oil | Wet (No Dry) | ○ | (Smooth/ No Creaking Noise) |
| | | Half Dry/Dry (viscous) | XX | (Large Noise) |
| | Engine Oil (automobile) | Wet (No Dry) | ○ | (Smooth/ No Creaking Noise) |
| | | Half Dry/Dry (viscous) | XX | (Large Noise) |
| | Grease (automobile) | Wet (No Dry) | ○ | (Not Smooth/ No Creaking Noise) |
| | Silicon oil | Enough Coating | ○ | (Smooth/ No Creaking Noise) |
| | Degrease *2 (Trichlene Cleaning) | No Contamination | ○ | (Not Smooth/ No Creaking Noise) |
| | Printing *3 (Meramine Alkyd) | No Contamination | ○ | (Large Friction/ No Creaking Noise) |
| | | Rust preventing oil Half Dry/Dry (viscous) | X | (Middle Creaking Noise) |

*1 Steel plate purchased
*2 Degreasing the steel plate on which the rust preventing oil
*3 Conventional printing black paint As seen in table 1:

1) a large creaking noise is produced if an oil component of a rust preventing oil or a lubricating oil sticks to a metallic surface;
2) there is no creaking noise if a metallic surface is completely cleaned by use of trichlene;
3) a creaking noise is not produced if a measure of rust is produced on a metallic surface; and
4) a creaking noise is not produced if a metallic surface is coated by printing melamine alkyd.

As a result of this test, the creaking noise is produced between a foamed urethane and a metallic surface when the foamed urethane is pushed and moved on the metallic surface if an oil component such as a rust preventing oil and oils and fats sticks to the metallic surface or the foamed urethane. If the metallic surface is completely degreased so as to observe no contamination of such an oil component and is then coated with silicon oil so as to slip or smoothly move, the creaking noise is not produced.

According to the above descriptions, the inventors of the present invention have found that it can be achieved to prevent the creaking noise production by eliminating the viscosity of an oil component such as a rust preventing oil and oils and fats which sticks to a metallic surface and by allowing to smoothly move a foamed urethane on the metallic surface. Also, it has been found that the viscosity of the oil component can be easily eliminated by treating directly the metallic surface rather than by treating the foamed urethane.

As a technique for eliminating the viscosity of the oil component, it is known to apply a surfactant so as to modify the oil component into a hydrophilic emulsion or gel by absorbing the oil component. Meanwhile, it has been found that when a metallic surface to which an oil component sticks is treated by use of a novel noise inhibitor of the present invention so as to modify the oil component into an emulsion or a gel, a foamed urethane is smoothly moved on the metallic surface.

In addition to this matter, as a result of modifying the oil component into a hydrophilic material, if a large quantity of hydrophilic radical is retained on the metallic surface, a desired ability of an oil component such as a rust preventing oil and a lubricating oil may be degraded. However, it has been found that a good workability is obtained and the effect is improved by retaining a least amount of lipophilic radical required to keep the ability.

In addition to this matter, it has been found that the above effect can be obtained even though the noise inhibitor of the present invention coated on a metallic surface is not only in a wet condition but also in a half dry condition.

EXAMPLES

Examples of novel noise inhibitors of the present invention are shown in table 2. This table also shows other characteristics such as the separation of each solution, the wetting, the anticorrosion and the noise production when each solution is coated on a metallic surface with a rust preventing oil. Note that pH is adjusted so as to improve the rust preventing effect.

As shown in table 2, Experiments 1–4 show that the creaking noise preventing effect can be obtained, and Examples 1–5 show that the desirable effects related to the solution separation, the wetting and the anti corrosion are further obtained.

Experiment 1

A typical non-ionic water-soluble surfactant (A) (HLB=13.7) is diluted by 15 times with water. The range of pH of this solution is from 6 to 8. By use of this solution as a noise inhibitor, any creaking noise is not observed but both the wetting to a metallic surface and the anticorrosion are no good.

Experiment 2

An oil-soluble surfactant (B) (HLB=8.4) that increases a lipophilic radical is diluted by 10 times with water. In this experiment, as a result of using this solution as a noise inhibitor, any creaking noise is not observed and the wetting to a metallic surface is good. However, the anticorrosion is not enough and the separation is disadvantageously occurred in the solution diluted by 10 times. Thus, this solution is not applicable for a practical use.

Experiment 3

A lipohilic oil-soluble surfactant (B) is mixed to a hydrophilic water-soluble surfactant (C). The mixing rate of the surfactant (B) to (C) is 7.4:2.5. The mixture is diluted into 10 times with water so as to adjust its HLB to 10.1. This solution has pH=9.0. In this experiment, as a result of using this solution as a noise inhibitor, any creaking noise is not observed and both the solution separation and the wetting are improved. However, the anticorrosion is not enough.

Experiment 4

This experiment is substantially the same as Experiment 3, excepting that diluting by 8 times with a wax emulsion (A). Note that the wax emulsion (A) is diluted by 5 times with water. In this experiment, as a result of using this solution as a noise inhibitor, any creaking noise is not observed and both the solution separation and the wetting are improved. However, the anticorrosion is no good. This implies that a manner of wax treatment affects the rust preventing effect.

Example 1

This example is similar to Experiment 3 but the mixing rate of the water-soluble surfactant (C) is decreased. The mixture is diluted by 8 times with water so as to adjust its HLB to 9.5. This solution has pH=9.0. In this example, as a result of using this solution as a noise inhibitor, any creaking noise is not observed, and all of the solution separation, the wetting and the anticorrosion are good.

Example 2

This example is similar to Example 1 but the mixing rate of the water-soluble surfactant (C) is further decreased. The mixture is diluted by 10 times with water so as to adjust its HLB to 9.1. This solution has pH=9.0. In this example, as a result of using this solution as a noise inhibitor, all characteristics are good as well as Example 1.

Example 3

This example is similar to Example 2 but the mixing rate of the water-soluble surfactant (C) is further decreased. The mixture is diluted by 8 times with water so as to adjust its HLB to 8.7. This solution has pH=9.0. In this example, as a result of using this solution as a noise inhibitor, all characteristics are good as well as Examples 1 and 2.

Example 4

This example is similar to Example 3 but the mixing rate of the water-soluble surfactant (C) is further decreased. The mixture is diluted into 5 times with water so as to adjust HLB to 8.5. This solution has pH=9.0. In this example, as a result of using this solution as a noise inhibitor, all characteristics are good as well as Examples 1, 2 and 3.

Example 5

In this example, the mixing rate of the water-soluble surfactant is the same as that of Example 2, and the mixture is diluted by 10 times with a wax emulsion solution (A) diluted by 5 times with water. In this example, as a result of using this solution as a noise inhibitor, as well as other examples, all characteristics are good. Note that, in this example, the mixture has white color so that a coated area can be identified clearly. This matter is not found in any other examples. Also, in this example, the anticorrosion is advantageously expected to improve more than that of other examples.

TABLE 2

EXPERIMENTAL RESULTS OF SURFACTANT COMPOSITION/METAL WITH RUST PREVENTING OIL

| | EXPERIMENT | | | |
|---|---|---|---|---|
| | 1 | 2 | 3 | 4 |
| SURFACTANT A | 10 | | | |
| SURFACTANT B | | 10 | 7.5 | 7.5 |
| SURFACTANT C | | | 2.5 | 2.5 |
| IONICITY | Non-ion | Non-ion | Non-ion | Non-ion |

TABLE 2-continued

| EXPERIMENTAL RESULTS OF SURFACTANT COMPOSITION/METAL WITH RUST PREVENTING OIL | | | | | | | | |
|---|---|---|---|---|---|---|---|---|
| HLB (solo) | 13.7 | 8.4 | 8.4 | 15.0 | 8.4 | 15.0 | | |
| MAIN COMPONENT* | A | B | B | C | B | C | | |
| pH (solo) | 6–8 | 5.5–8.5 | 5.5–8.5 | 7 | 5.5–8.5 | 7 | | |
| HLB (mixture) | 13.7 | 8.4 | 10.1 | | 10.1 | | | |
| WAX EMULSION A | — | — | — | | — | | | |
| WAX EMULSION B | — | — | — | | 70 (diluted in 5 times) | | | |
| WATER | 90 | 90 | 90 | | — | | | |
| TOTAL AMOUNT | 150 | 100 | 100 | | 80 | | | |
| DILUTION (times) | 15 | 10 | 10 | | 8 | | | |
| pH (mixture) | 7.0 | 7.0 | 9.0 | | 9.0 | | | |
| SOLUTION (SEPARATION) | None | Separate | None | | None | | | |
| WETTING | No Good | Good | Good | | Good | | | |
| ANTI CORROSION | xx | Δ–○ | Δ | | x | | | |
| CREAKING NOISE | None | None | None | | None | | | |

| | EXAMPLE | | | | | | | | | |
|---|---|---|---|---|---|---|---|---|---|---|
| | 1 | | 2 | | 3 | | 4 | | 5 | |
| SURFACTANT A | | | | | | | | | | |
| SURFACTANT B | 8.3 | | 9.0 | | 9.5 | | 9.8 | | 9.0 | |
| SURFACTANT C | | 1.7 | | 1.0 | | 0.5 | | 0.2 | | 1.0 |
| IONICITY | Non-ion | | Non-ion | | Non-ion | | Non-ion | | Non-ion | |
| HLB (solo) | 8.4 | 15.0 | 8.4 | 15.0 | 8.4 | 15.0 | 8.4 | 15.0 | 8.4 | 15.0 |
| MAIN COMPONENT* | B | C | B | C | B | C | B | C | B | C |
| pH (solo) | 5.5–8.5 | 7 | 5.5–8.5 | 7 | 5.5–8.5 | 7 | 5.5–8.5 | 7 | 5.5–8.5 | 7 |
| HLB (mixture) | 9.5 | | 9.1 | | 8.7 | | 8.5 | | 9.1 | |
| WAX EMULSION A | — | | — | | — | | — | | 90 (diluted in 5 times) | |
| WAX EMULSION B | — | | — | | — | | — | | — | |
| WATER | 70 | | 90 | | 70 | | 40 | | — | |
| TOTAL AMOUNT | 80 | | 100 | | 80 | | 50 | | 100 | |
| DILUTION (times) | 8 | | 10 | | 8 | | 5 | | 10 | |
| pH (mixture) | 9.0 | | 9.0 | | 9.0 | | 9.0 | | 9.0 | |
| SOLUTION (SEPARATION) | None | | None | | None | | None | | None | |
| WETTING | Good | | Good | | Good | | Good | | Good | |
| ANTI CORROSION | ○ | | ◎ | | ◎ | | ◎ | | ◎ | |
| CREAKING NOISE | None | | None | | None | | None | | None | |

*A Polyethylene glycol mono-oleic acid type
B Polyethylene glycol di-oleic acid
C Polyoxyethylene sorbitane mono-oleic acid type This table shows that several characteristics such as the creaking noise preventing ability, the rust preventing ability, the wetting and the solution separation are strongly correlated to HLB and pH values. That is, in order to obtain a desirable effect, it is important that the surfactant has HLB= 8.0–10 and more than 10%, preferably more than 12.5% of solute.

By coating a noise inhibitor of the present invention on a metallic surface to which an oil component sticks, a non-viscous film layer is formed on the metallic surface, and this layer is placed between a foamed urethane and the metallic surface so that the creaking noise production is prevented.

In the art, the creaking noise has been prevented by use of a pad such as a non-woven cloth and the like or by coating an expensive noise-preventing agent. In the present invention, by use of the novel noise inhibitor, the creaking noise production is prevented more easily and more cheaply than the art.

According to the present invention, even though a rust preventing oil as an oil component sticks to a metallic surface, the wetting is good and a water component is removed for a relatively short time so as to handle it more easily. Also, the rust preventing effect is kept and the creaking noise production can be prevented even though the coated metallic surface is not only in a dry condition but also in a wet condition.

What is claimed is:

1. A noise inhibitor for treating a metallic surface to prevent a creaking noise produced between a foamed urethane and said metallic surface when an oil component sticks to said metallic surface and said foamed urethane touches on said metallic surface, consisting of:

a non-ionic or a carboxylic acid type negative ionic oil-soluble surfactant; and water or a wax emulsion solution, said surfactant being diluted by 2 to 15 times with said water or said wax emulsion solution, wherein the range of HLB of said surfactant is from 8.0 to 10 and the range of pH of said noise inhibitor is from 7.5 to 9.5.

2. A noise inhibitor of claim 1 further including a water-soluble surfactant, wherein the range of HLB of said water-soluble surfactant is from 10 to 15 and where the mixture of said oil-soluble surfactant and said water-soluble surfactant is from 8.0 to 10.

3. A noise inhibitor of claim 1 wherein the range of HLB of said surfactant is from 8.5 to 9.5.

4. A noise inhibitor of claim 1 wherein said surfactant is diluted by 5 to 10 times.

5. A noise inhibitor of claim 1 wherein said wax emulsion is diluted by 1 to 10 times.

6. A method for treating a metallic surface to prevent a creaking noise produced between a foamed urethane and said metallic surface when an oil component sticks to said metallic surface and said foamed urethane touches on said metallic surface, comprising the step of coating thinly the noise inhibitor of claim 1 on said metallic surface, thereby, the oil component is emulsified or gelled so as not to exhibit the viscosity, and after drying, a non-viscous film layer is formed on said metallic surface.

7. A noise inhibitor of claim 2 wherein the range of HLB of said surfactant is from 8.5 to 9.5.

8. The noise inhibitor of claim 1, where said oil-soluble surfactant is a polyethylene glycol diester.

9. The noise inhibitor of claim 8, where said polyethylene glycol diester is polyethylene glycol dioleate.

10. The noise inhibitor of claim 2, where said water-soluble surfactant is a polyethylene glycol diester.

11. The noise inhibitor of claim 10, where said polyethylene glycol diester is selected from the group consisting of polyethylene glycol monooleate and polyoxyethylene sorbitan monooleate.

12. A noise inhibitor comprising:

an oil-soluble surfactant, where the range of HLB of said oil-soluble surfactant is from 8.0 to 10, a water-soluble surfactant, where the range of HLB of said water-soluble surfactant is from 10 to 15, and where the HLB of the mixture of said oil-soluble surfactant and said water-soluble surfactant is from 8.0 to 10, and water or a wax emulsion, where the ratio of said oil-surfactant to said water or said wax emulsion is 1:2 to 1:15, and where the pH of the inhibitor is 7.5 to9.5.

13. The noise inhibitor of claim 12, where said oil-soluble surfactant is a polyethylene glycol diester.

14. The noise inhibitor of claim 12, where said water-soluble surfactant is a polyethylene glycol diester.

15. The noise inhibitor of claim 13, where said polyethylene glycol diester is a polyethylene glycol dioleate.

16. The noise inhibitor of claim 14, where said polyethylene glycol diester is selected from the group consisting of polyethylene glycol monooleate and polyoxyethylene sorbitan monooleate.

* * * * *

UNITED STATES PATENT AND TRADEMARK OFFICE

CERTIFICATE OF CORRECTION

PATENT NO. : 6,358,890 B1 
DATED : March 19, 2002
INVENTOR(S) : Yasumasa Senoo, Takao Komatsubara and Fumio Goto It is certified that error appears in the above-identified patent and that said Letters Patent is hereby corrected as shown below:

Column 10,
Line 9, delete “to9.5”, and substitute -- to 9.5 --.

Signed and Sealed this

Seventh Day of March, 2006

JON W. DUDAS
*Director of the United States Patent and Trademark Office*

UNITED STATES PATENT AND TRADEMARK OFFICE

CERTIFICATE OF CORRECTION

PATENT NO. : 6,358890 B1
APPLICATION NO. : 09/530070
DATED : March 19, 2002
INVENTOR(S) : Yasumasa Senoo, Takao Komatsubara and Fumio Goto It is certified that error appears in the above-identified patent and that said Letters Patent is hereby corrected as shown below:

Claim 1, column 8, line 47, delete the words “a carboxylic acid type negative ionic”, and insert therefor -- anionic --; at line 48, after the word “surfactant”, insert -- wherein the anionic surfactant derives from a carboxylic acid --.

Signed and Sealed this

Eighth Day of August, 2006

JON W. DUDAS
*Director of the United States Patent and Trademark Office*